US005437755A

United States Patent [19]

Lavorel et al.

[11] Patent Number: 5,437,755

[45] Date of Patent: Aug. 1, 1995

[54] PROCESS FOR DECORATING THE TOP PORTION OF THE SKI

[75] Inventors: Pierre-Yves Lavorel, Frangy; Alain Grenetier, Annecy, both of France

[73] Assignee: Salomon S.A., Metz-Tessy, France

[21] Appl. No.: 179,229

[22] Filed: Jan. 10, 1994

[30] Foreign Application Priority Data

Jan. 12, 1993 [FR] France ..... 93 00315

[51] Int. Cl.[6] ..... B44C 1/16

[52] U.S. Cl. ..... 156/240; 156/235; 156/277; 156/90; 8/471; 280/610

[58] Field of Search ..... 156/71, 230, 235, 240, 156/249, 277, 234, 90; 428/203, 204, 227, 913.3; 8/471, 467; 280/610

[56] References Cited

U.S. PATENT DOCUMENTS

| | | | |
|---|---|---|---|
| 3,264,164 | 8/1966 | Jerothe | 156/240 X |
| 3,704,023 | 11/1972 | Downs | 280/11.13 L |
| 3,727,936 | 4/1973 | Klir | 280/11.13 L |
| 4,047,735 | 9/1977 | Ferch | 280/610 X |
| 4,077,652 | 3/1978 | McCaskey | 280/610 X |
| 4,293,603 | 10/1981 | Hayman-Chaffey | 428/203 X |
| 4,395,263 | 7/1983 | Davis | 8/471 X |
| 4,895,830 | 1/1990 | Takeda | 503/227 |
| 4,921,513 | 5/1990 | Parten | 156/249 X |
| 4,997,506 | 3/1991 | Recher | 156/235 X |
| 5,021,278 | 6/1991 | Short | 428/904 X |
| 5,032,139 | 7/1991 | Recher et al. | 8/471 |
| 5,055,525 | 10/1991 | Henton et al. | 525/66 |
| 5,102,716 | 4/1992 | Balmer | 428/203 X |
| 5,173,226 | 12/1992 | Cazaillon et al. | 264/46.6 |
| 5,270,097 | 12/1993 | Amemiya | 428/156 X |
| 5,290,591 | 3/1994 | Lussi | 427/202 X |

FOREIGN PATENT DOCUMENTS

| | | | |
|---|---|---|---|
| 0355829 | 2/1990 | European Pat. Off. | 428/204 |
| 2387793 | 11/1978 | France . | |
| 2421071 | 10/1979 | France . | |
| 2580943 | 10/1986 | France . | |
| 2596286 | 10/1987 | France . | |
| 2620974 | 3/1989 | France . | |
| 2620975 | 3/1989 | France . | |
| 2654644 | 5/1991 | France . | |
| 0113675 | 9/1979 | Japan | 428/204 |
| 0164124 | 12/1980 | Japan | 428/203 |
| 61-154586 | 7/1986 | Japan . | |
| 0166950 | 6/1989 | Japan | 428/203 |
| 2136356 | 9/1984 | United Kingdom | 428/203 |

*Primary Examiner*—David A. Simmons
*Assistant Examiner*—Paul M. Rivard
*Attorney, Agent, or Firm*—Sandler, Greenblum & Bernstein

[57] ABSTRACT

A process for decorating the top portion of the ski including a step of assembling and affixing an external, thick layer of transparent plastic material onto an opaque internal layer. Prior to the assembly step, the first decoration is transferred onto the external surface of the external layer and a second internal decoration, different from the first, is transferred onto one of the surfaces connecting the internal layer with the external layer. The invention enables an economical production of varied and easily interchangeable decorations.

19 Claims, 3 Drawing Sheets

PROCESS FOR DECORATING THE TOP PORTION OF THE SKI

BACKGROUND OF THE INVENTION

1. Field of the Invention

The present application concerns a process for decorating the top portion of the ski. The word "ski" is used herein in a broad sense, and it includes, e.g., the alpine ski, crosscountry ski, mono-ski and snowboard.

2. Discussion of Background and Material Information

It is required for the upper surface of a ski to have a certain number of characteristics: various aesthetic markings and motifs, the trademark or brand, identification of the ski model, indications relative to the size or mounting of the bindings, and others. Ever increasing in number, these distinctive signs and aesthetic elements must be easily distinguished from one another. The enhancement of the decoration by creating new and attractive effects is an increasingly important concern for material manufacturers. Of course, stresses due to the utilization of skis, especially stresses due to the resistance of the surface and decoration to mechanical shocks and physical contact with running edges of other skis, of the ski pole and physicochemical affects (temperature, ultraviolet light, solvents, humidity) must be taken into account.

Moreover, the interchangability of decorations from one model to another and from one year to another must be quick and economical. Thus, models from the same line often have motifs or markings in common, and others that are distinctive. On account of the growing number of models of the various manufacturers, management of the decoration and markings is increasingly burdensome, complex and expensive.

Known methods for decorating or marking the upper surface of the ski generally made of a plastic material, include printing means such as, silk screen printing, sublimation, heat marking or tampography.

Japanese Patent Publication No. 61-154586 describes a process for decorating a ski by silk screening. The purpose of such process is to print letters or motifs by using a high surface tension ink in order to obtain drawings or projecting letters on the ski. A disadvantage of this type of decoration is its poor resistance to wear and a short-lived aesthetic effect.

Applicant's French Patent Publication No. 2,620,975 describes a sublimation decorating process which includes transferring sublimable inks from a decorative motif onto the external surface of an opaque monolayer contrast sheet; then assembling the monolayer sheet with the rest of the ski by heat adhesion.

French Patent Publication No. 2,387,793 describes a sublimation transfer process of a sublimable coloring agent in a transparent layer affixed to a layer of a binding agent containing a pigment.

French Patent Publication No. 2,620,974 concerns a decorating process using a bi-layer sheet; one of the layers being transparent, the other layer being opaque. The transfer is undertaken by sublimation onto the external surface of the opaque layer. The bi-layer thus is then assembled with the ski by applying the external opaque surface side onto the upper surface of the body of the ski.

French Patent Publication No. 2,580,943 concerns marking a formed ski. To this end, the marking is performed on a planar sheet of translucent material. The sheet is formed and attached to the surface of the ski such that the marking is located on the side of the sheet in contact with the upper surface of the ski. The marking is thus protected against external physical sources of contact.

French Patent Publication No. 2,596,286 pertains to a protection element of a ski, comprising two, chemically different layers assembled with one another. The internal opaque layer is soft and adapted for adhering, while the external transparent layer is rigid. The decoration can be printed by sublimation or silk screening onto the lower surface of the flexible layer.

French Patent Publication No. 2,421,071 concerns an embodiment of the upper surfaces of the ski, which consists of serigraphically/silk screen printing a decoration onto a paper, covering the upper surface of the decorated paper with a transparent paper and its lower surface with one or more stacked support-papers. Then, the assembly with multiple thicknesses thus obtained is impregnated in a synthetic bath. Finally, the assembly is pressed at a high temperature and cut out, in order to be adhered onto the top surface of the ski.

The current state of decoration processes limits the possibilities for obtaining durable decorations that are sufficiently rich and distinguishable, and easily interchangeable, while remaining economical.

SUMMARY OF THE INVENTION

Therefore, an object of the present invention is to propose a process for decorating the top portion of a ski, which has the advantages stated above.

Also, one of the objects of the invention is to enable an easy and economical provision of varied and interchangeable decorations. In particular, the decoration can be obtained for a complete line of skis, composed of having sufficiently different and distinctive decorative motifs, without it being required to conceive a complete decoration for each model.

Another object of the invention is to enable new, decorative, and aesthetic effects to be obtained such as depth and relief effects, or variable effects as a function of the top viewing angle, to be obtained on a ski.

Another object of the invention is to enable the provision of a decoration that is durable against external aggressions under any condition of use.

To this end, the invention concerns a process for decorating the top portion of the ski, comprising a step for assembly and affixing an external, thick, layer of transparent plastic material onto an opaque internal layer. Prior to the assembly step, a first decoration is transferred onto the external surface of the external layer, and a second internal decoration, different from the first is transferred onto one of the surfaces connecting the internal layer with the external layer.

The thickness of the transparent layer is greater than 0.5 mm and, preferably, between 0.5 mm and 1.1 mm.

The first and/or the second decoration(s) is (are) applied according to a printing method by sublimation, serigraphy, tampography or hot marking. Tampography refers to a method of printing or marking by the use of a pad of elastomeric or other soft material having thereon a motif in relief which is dipped in an ink bath, whereafter the inked pad is applied to the object to be marked. Hot marking refers to a method of printing or marking by using heat and pressure to transfer a pattern film from a carrier sheet to an object.

In a first embodiment, the second decoration is applied onto the internal surface of the transparent external layer.

A support paper bearing sublimable coloring agents is placed on each surface of the transparent layer; the heat transfer of the inks from each paper into the transparent layer is undertaken simultaneously. The thickness of the layer must be greater than the total penetration depth of the inks. The external layer thus printed is then assembled and affixed to the opaque layer.

The external transparent layer and internal opaque layer are chosen from materials having near or neighboring fusion temperatures, and the two layers are affixed to one another by welding.

The external transparent layer is an ABS or AS mixed with a TPU (thermoplastic polyurethane elastomer) and the internal opaque layer is an ABS or AS mixed with a TPU or an ABS or pure AS.

In a second embodiment, the second decoration is applied on the surface of the internal opaque layer intended to come into contact with the internal surface of the transparent layer during the assembly and affixing step. A support paper bearing sublimable inks is placed on one of the surfaces of the external layer; a solid film of thermofusible glue, having good properties of adhesion with the internal and external layer, is placed on the other surface of the layer. Simultaneously, the inks are heat transferred, and the film is adhered onto the external transparent layer is then assembled onto the internal opaque layer by applying the adhering film surface onto the decorated surface of the internal opaque layer, and then heating to obtain adhesion. The external transparent layer is chosen from among aliphatic polyamides, preferably, polyamides 11 or 12, having good UV resistance and suitable for sublimation, the internal opaque layer is chosen from among aliphatic polyamides, polyamide-based copolymers such as polyesteramides, polyetheramides, polyamide-based and modified polyolefin-based copolymer compounds, styrene and carboxylic or its hydrous acid copolymers.

The adhering film is polymer or copolymer-based polyethylene or EVA (ethylene-vinyl acetate) grafted by carboxylic acid, anhydrous carboxylic acid, or carboxylic acid ester action.

BRIEF DESCRIPTION OF THE DRAWINGS

Other characteristics and advantages of the invention will become apparent from the following description, with reference to the annexed drawings which are only given as non-limiting examples.

DETAILED DESCRIPTION OF THE PREFERRED EMBODIMENTS

Figure 1:
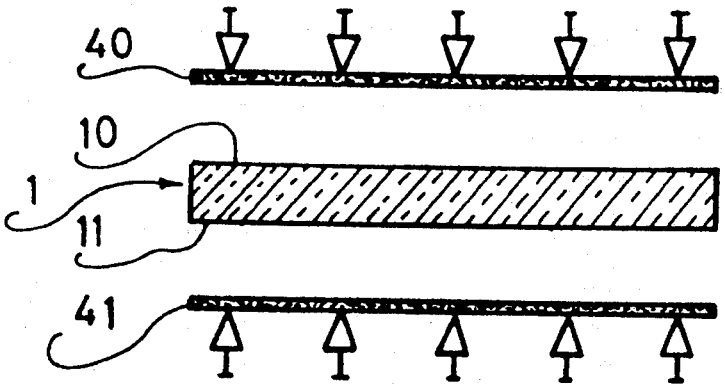
FIGS. 1 to 5 illustrate a first embodiment of the decoration of the top portion of the ski according to the process.

The process according to the invention initially requires the utilization of a plastic monolayer sheet 1 made of a transparent or translucent material; this sheet will be designated as "transparent layer" hereinafter. A decoration is printed on each surface 10, 11 of the layer 1 by transfer of sublimable coloring agents. The decorative motif to be printed in a known manner, is contained on a sheet of support paper 40, 41 which is applied under a pressure P at a temperature T, for a time t, against each of the surfaces 10, 11. The transfer preferably occurs on both surfaces simultaneously. According to one characteristic of the invention, the conditions of the sublimation reaction have been determined, so that, taking into account the thickness e of the transparent layer 1, the migration fronts 50, 51 of the sublimated coloring agents do not join one another. In other words, the sum of the penetration depths p1 and p2 of the inks is less than the thickness e of the transparent layer.

In the particular case of the described example, the transparent layer is constituted of a transparent ABS (Acrylonitrile, Butadene, Styrene) or AS (Acrylonitrile, Styrene) in the proportion of 70 to 95% mixed with a TPU (Thermoplastic Polyurethane Elastomer) with a hardness of between 95 shA and 80 shA in the proportion of 30 to 5%; the first proportion, however, has the tendency of producing yellowing dyes over time. As compensation, any proportion provides excellent cracking resistance at very low temperatures. Such a sheet has the advantage of being easily formed onto a non-planar ski structure after decoration.

The thickness of the layer is greater than 0.5 mm, and is preferably contained between 0.5 mm and 1.1 mm. The sublimation is performed at a temperature of 160° C., and a pressure of 1 bar for approximately 3 minutes and 30 seconds. The limiting depth of each front is approximately, or slightly higher than, 100 μm. Of course, the motifs of each decoration are different and cannot but partially cover the surface of each side 10, 11 of the layer.

Figure 3:
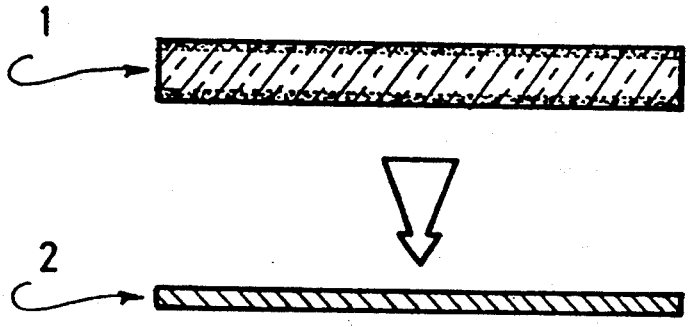
Figure 4:
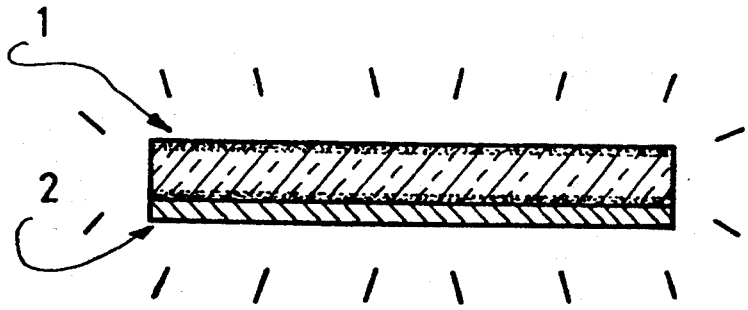

According to FIG. 3, the following step consists of assembling the layer thus pre-decorated onto a second layer or sheet 2 made of an opaque material. In the specific example described, the material is identical to that of the transparent layer 1 or is a pure ABS. It is important for both layers 1, 2 to have near or neighboring fusion temperatures so that they can be affixed to one another by thermowelding (FIG. 4).

The second layer 2 is made opaque by pigmentation, preferably in white, for example, by means of titanium dioxide incorporated into the manufacturing, with respect to the pigmentation of the contrast layer intended to reveal the two superimposed decorations, it must be specified that it is in no way limited to the color white. The use of the entire range of clear, metallic, or pearly dyes, for example, is contemplated.

Figure 2:
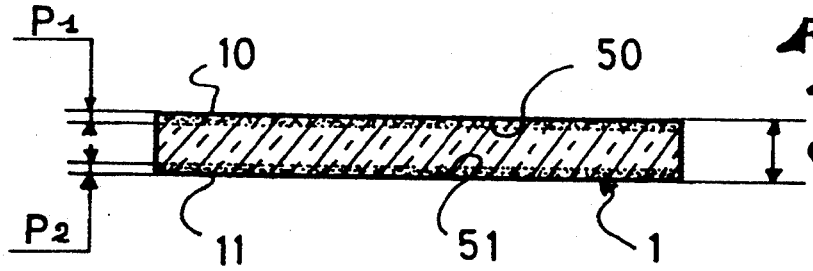

According to a variant of FIGS. 1 and 2, it may be provided that after decoration of the transparent layer 1, a layer of lacquer is simply applied onto the internal surface 1 of the layer to reveal the decoration. In this case, the lacquer replaces the opaque layer 2.

The sublimation technique is given as a preferred embodiment of the invention because it enables very rich, and especially, durable decorations to be obtained. Such decorations are particularly resistant to abrasion due to the ink gradient created in depth. If the thickness of the transparent layer is sufficient, one can obtain very defined relief effects allowing, for example, to keep a common background motif and interchange a surface motif in order to distinguish between ski models of the same line.

However, the invention extends to other techniques or methods of ink transfer, such as serigraphy, tampography, or also, heat marking, for example. Thus, any of these techniques may be utilized for decorating each surface 10, 11 of the transparent sheet 1.

The use of the materials for each layer 1, 2 is not limited either. All materials capable of being easily thermowelded, suitable for decoration, and sufficiently resistant to constraints imposed by the act of skiing. The external layer must also be sufficiently transparent. Thus, one can add plastic materials such as polycarbonates, polyamides and derivatives, sulphonated polyesters, polyesters, transparent polyolefins such as low density polyethylenes and polypropylenes, and plasticized PVC (polyvinylchloride).

Nevertheless, it must be noted that conventional markings are difficult to obtain on certain plastics such as polycarbonates.

Figure 5:
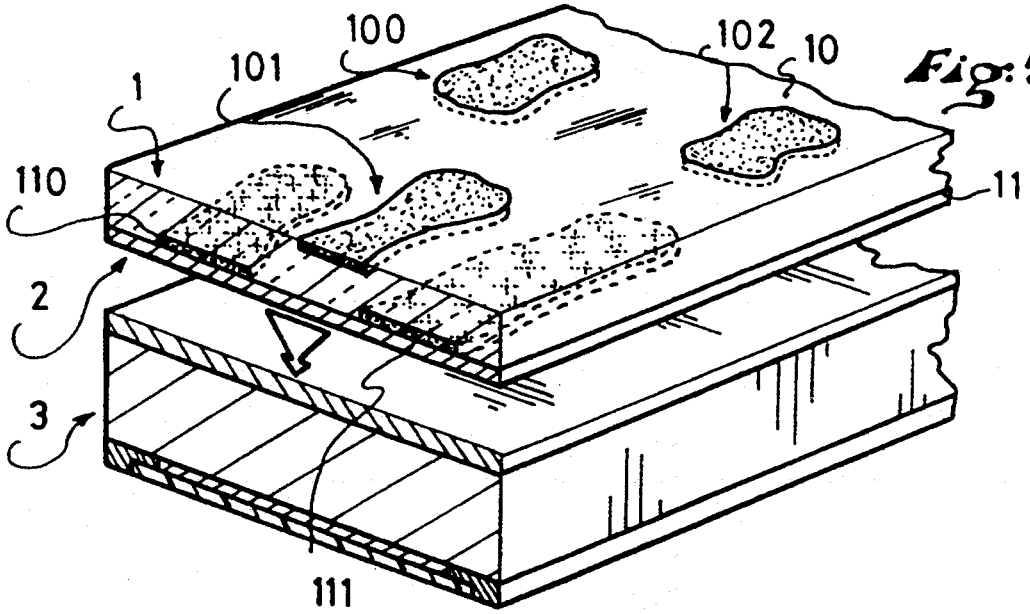

The bi-layer decoration thus formed is then assembled with the remaining structure 3 of the ski as illustrated in FIG. 5. Thus, affixing of the internal opaque layer 2 can be obtained by any means known by one with ordinary skills in the art, e.g., either with a glue comprising organic solvents, or thermohardenable glues (epoxy, polyester, or phenolics) or also thermofusible glues, in the form of solid and easily handled films, for example.

Figure 11:
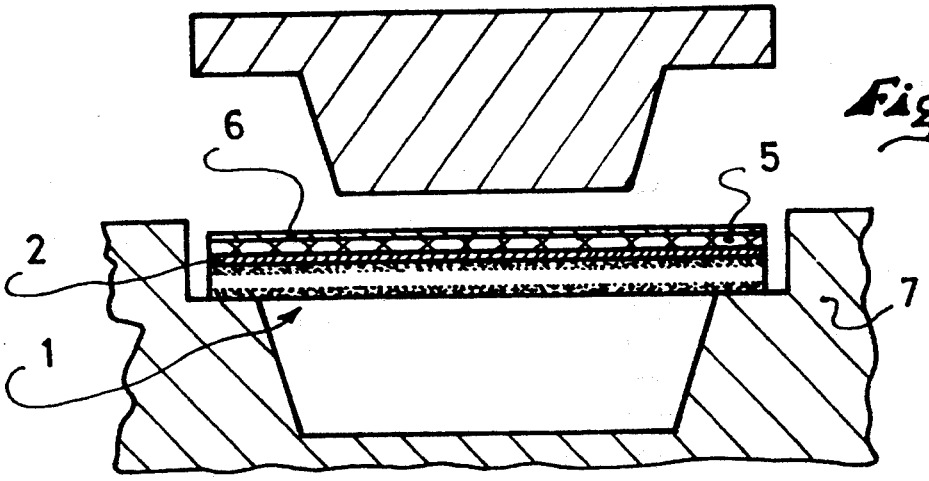
FIGS. 11 and 12 illustrate a non-limiting example of the conformation of a top portion decorated according to the process of the invention and its simultaneous adhering with an upper reinforcement element.
Figure 12:
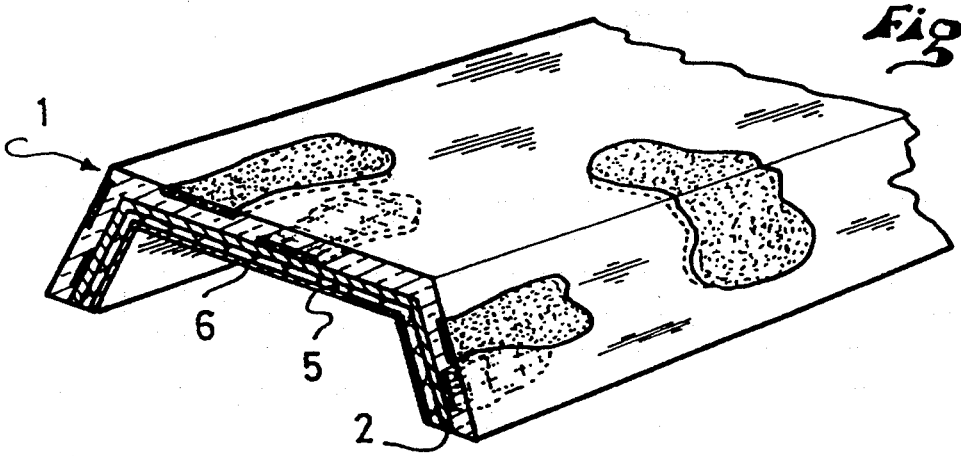

The assembly or adhering phase can be integrated into a more complex process in the field of modern ski manufacturing. FIGS. 11 and 12 are an example thereof providing a more specific description later.

As shown in FIG. 5, the transparent layer 1 constitutes the external layer of the ski. It comprises motifs 100, 101, 102 into the foreground which have been transferred onto the external surface 10, and motifs 110, 111 into the background, different from motifs 100, 101, 102, which have been transferred onto the internal surface 11. The relief effect can be more or less defined according to the thickness of the layer, the penetration depth of the inks, and the nature of the material which more or less diffuses the ink providing a more or less substantial contrast.

Another embodiment of the process according to the invention, as illustrated in FIGS. 6 to 10, can be envisioned when one wishes to use materials of a different nature for each layer 1, 2. In such case, the decoration is transferred onto one of the surfaces 10 of the transparent layer 1 only. To this end, the decoration paper sheet 40 retaining the sublimable inks is applied onto the surface 10. Simultaneously, a transparent adhering film 4 is applied onto the other surface 11. This film is solid and thus easily handled at room temperature. This film is known as a "compatibilizer", i.e., it is chosen for its good adhesion properties, both with the material of the layer 1 and the material of the opaque layer onto which the transparent layer 1 is intended to contact. The film may be either monolayer or bi-layer. It has a very low thickness in the order of a few microns.

In the particular case of the example described, the applicant chooses to use a transparent layer made of aliphatic polyamide, preferably, P11 or P12 adapted to form the layer exposed to atmospheric influences and mechanical stresses. These materials have the abilities of being transparent, resistant to UV, hot flow and cold cracking. They are also easily sublimable.

The thickness e of the layer must be chosen so as to be greater than the penetration depth p of the inks.

The sublimation conditions are chosen such that the transfer of the inks into the layer, and adhesion of the adhering film can be undertaken simultaneously. Thus, with the chosen materials, the temperature is 180° C. at a pressure of 2 bar for approximately 2 minutes and 30 seconds.

During the same time (FIG. 8), the process requires the use of a second opaque layer 2 onto one surface 20 of which, a second decoration is transferred. As before, a paper 41 containing the sublimable inks is applied on the surface 20 and is heated by maintaining a certain pressure for a certain time. In the case described, the layer is constituted of a material comprised of a styrene and maleic anhydride (SMA) copolymer. This material is particularly well adapted to decoration by sublimable ink transfer.

By using such material, the ink migration is performed in a moderate and lightly diffused manner, providing an interesting clarity of the motif. The color rendering and tint are excellent.

Figure 9:
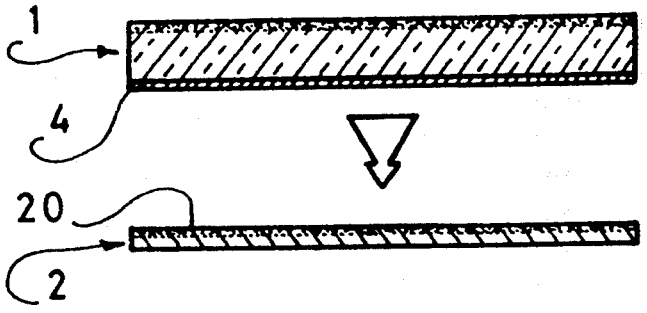
Figure 10:
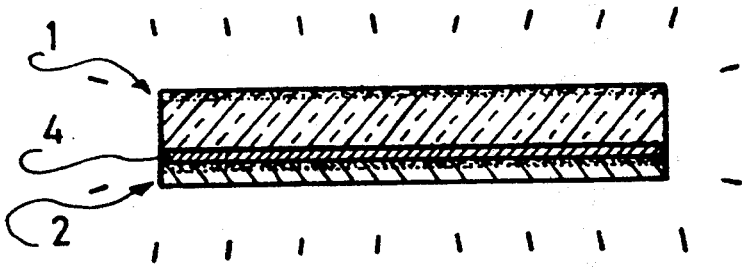

As illustrated in FIGS. 9 and 10, the following step consists of assembling both layers 1, 2 with one another. To this end, the surface 11 of the transparent layer 1 including the adhering film is applied on the surface 20 of the opaque layer 2 which has been pre-decorated. The adhesion of the opaque layer 2 is obtained by heating. Thus, a pressure on the order of 8 bar is applied at a temperature of 130° C. for 5 minutes. The choice of material of the layer is important because it must resist under the adhesion conditions to a downgrading of the sublimated decoration in the opaque layer. Indeed, proceeding to a second heating cycle under pressure has the tendency of causing a recovery of the ink diffusion inside the opaque layer. The inks affected by the phenomenon, which by their relative position define a specific decorative motif, will therefore diffuse in the material in totally disorderly fashion; which, within the scope of the process according to the invention, would seriously damage the quality of the decorative motif of the internal opaque layer.

As a non-limiting example, the internal opaque layer 2 may be chosen from among the aliphatic polyamides, polyamide-based copolymers such as polyesteramides or polyetheramides, polyamide and modified polyolefin-based copolymer compounds, styrene and acid copolymers, anhydrous or ester carboxylic, preferably maleic or anhydric.

The adhering films are polyethylene-based or EVA polymer or copolymer-based, grafted by anhydrous acid or carboxylic ester action.

As in the preceding case, the decorative sub-assembly of the decoration thus obtained is then assembled with the remaining elements of the ski within the scope of the manufacturing process itself.

Figure 6:
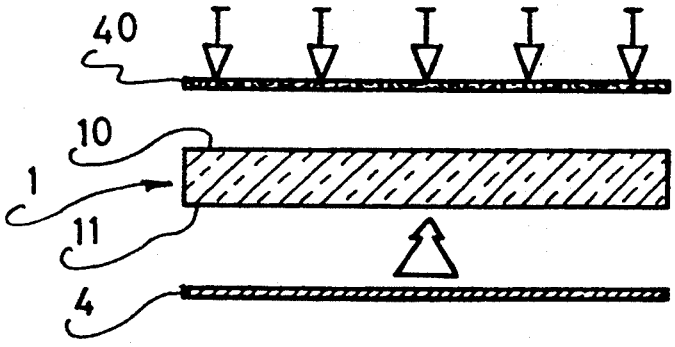
FIGS. 6 to 10 illustrate a second special embodiment of the process.
Figure 7:
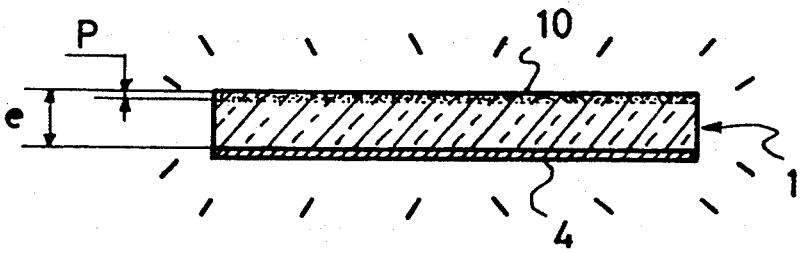
Figure 8:
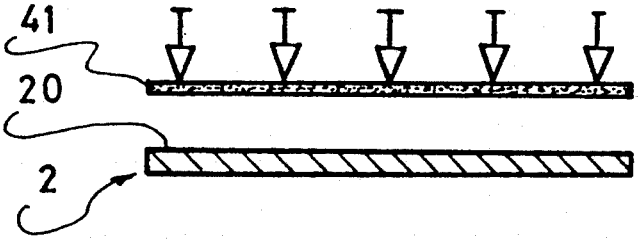

The adhesion of the film 4 onto the opaque layer 2 of the SMA is obtained by heating during second assembly step, illustrated in FIGS. 6 and 7.

FIGS. 11 and 12 illustrate an example for assembling and the decorative bi-layer comprising the pre-decorated external transparent layer 1 and the internal opaque layer 2 with the upper ski reinforcement element 5.

A stack of layers adapted to form the top portion of the ski is arranged in a heat forming mold comprising a lower matrix 7 the bi-layer 1, 2 predecorated according to the invention, a layer 5 adapted to form the upper reinforcement of the ski, and a solid compatibilizing film adapted to ensure adhesion of the top portion to the rest of the ski.

The reinforcement layer 5 is constituted by one or more reinforcing textile nappes pre-impregnated with a thermohardenable resin. In the case of a reinforcement 5 made of a textile nappe pre-impregnated with a thermohardenable resin, the heat pressing operation ensures the cross-linking, or the cross-linking complement of the resin and the adherence of the film 6 on the reinforcement 5. After hardening, the formed top portion can be removed.

The subsequent manufacturing operation consists of placing the top portion, as well as the lower elements (running edges, sole, lower reinforcement, etc.) into a mold, and then injecting a foam between these elements to obtain the core of the ski.

The manufacturing process is described more specifically in French Patent Publication No. 2,654,644 owned by the Applicant. Of course, it only constitutes a non-limiting example, which is merely given to illustrate the integration of the invention into the more general context of the production of the ski.

As a variant (not represented), one can provide that the transparent layer 1 and the opaque layer 2 be assembled with one another during the actual forming step of the top portion of the ski or integrated in a molding step of the ski.

The instant application is based upon French patent application 93.00315 of Jan. 12, 1993, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. Process for decorating the top portion of a ski, said process comprising the steps of:

assembling and affixing an external, thick layer of a transparent plastic material, onto an opaque internal layer, the external layer having a first connecting surface and said internal layer having a second connecting surface, said first connecting surface and said second connecting surface being connected by said step of assembling and affixing, wherein, prior to the assembling and affixing step, the process comprises the steps of transferring a first decoration onto an external surface of the external layer, and transferring a second internal decoration, different from the first, onto said second connecting surface connecting the internal layer with the external layer.

2. Process of decorating as defined by claim 1, wherein the thickness of the transparent layer is greater than 0.5 mm.

3. Process of decorating as defined by claim 1, wherein the first and/or second decoration(s) is (are) applied according to a printing method by sublimation, serigraphy, tampography, or hot marking.

4. Process of decorating as defined by claim 1, wherein:

a support paper bearing sublimable coloring agents is placed onto each surface of the transparent layer, simultaneous heat transfer is of the inks of from each paper into the transparent layer is performed; the thickness of said layer must be greater than the total penetration depths.

5. Process as defined by claim 4, wherein the external transparent layer and the internal opaque layer are chosen from materials with near fusion temperatures, and the two layers are affixed to one another by welding.

6. Process as defined by claim 5, wherein the external transparent layer is an acrylonitrile-butadiene-styrene mixed with a thermoplastic polyurethane elastomer or an acrylonitrile-styrene mixed with a thermoplastic polyurethane elastomer, and wherein the internal opaque layer is an acrylonitrile-butadiene-styrene mixed with a thermoplastic polyurethane elastomer or an acrylonitrile-styrene mixed with a thermoplastic polyurethane elastomer or an acrylonitrile-styrene mixed with an acrylonitrile-butadiene-styrene or only acrylonitrile-styrene.

7. Process for decorating the top portion of a ski, said process comprising the steps of:

assembling and affixing an external, thick layer of a transparent plastic material, onto an opaque internal layer, wherein, prior to the assembly step, the process comprises the steps of transferring a first decoration onto an external surface of the external layer, and transferring a second internal decoration, different from the first, onto one of the surfaces connecting the internal layer with the external layer, wherein the second decoration is applied on the surface of the internal opaque layer intended to come in contact with the internal surface of the transparent layer during the assembly and affixing step, a paper support bearing the sublimable inks is placed on one of the surfaces of the external transparent layer, a solid film of thermofusible glue having good properties of adhesion with the internal and external layer, is placed onto the other surface of said layer, simultaneous heat transfer of inks and adhesion of adhering film onto the external transparent layer is performed, the external transparent layer is assembled onto the internal opaque layer by applying the adhering film surface onto the decorated surface of the internal opaque layer and then heated to obtain adhesion.

8. Process as defined by claim 7, wherein the external transparent layer is chosen from among aliphatic polyamides, preferably polyamides 11 or 12, having good resistance to ultraviolet radiation and being suitable for sublimation.

9. Process as defined by claim 7, wherein the internal opaque layer is chosen from among aliphatic polyamides, polyamide-based copolymers such as polyesteramides, polyetheramides, polyamide-based and modified polyolefin-based copolymer compounds, styrene and carboxylic acid or its anhydride copolymers.

10. Process as defined by claim 7, wherein the adhering film is polymer or copolymer-based polyethylene or ethylene-vinyl acetate grafted by by action of carboxylic acid, anhydrous carboxylic acid or carboxylic acid ester.

11. Process as defined by claim 1, wherein the thickness of the transparent layer is between 0.5 mm and 1.1 mm.

12. Process as defined by claim 7, wherein the external transparent layer is polyamide 11 or polyamide 12, having good UV resistance and being suitable for sublimation.

13. Process as defined by claim 7, wherein the internal opaque layer is chosen from among polyesteramides, polyetheramides, polyamide-based and modified polyolefin-based copolymer compounds.

14. A process of decorating an upper portion of a ski, said upper portion of the ski including an internal layer and a transparent external layer, said internal layer having an external surface and said external layer having an internal surface and an external surface, said process comprising:

transferring a first decoration onto said external surface of said transparent external layer;

transferring a second decoration onto said external surface of said internal layer; and affixing said transparent external layer to said internal layer.

15. A process according to claim 14, wherein:

said transparent external layer has a thickness greater than 0.5 mm.

16. A process according to claim 1, wherein:

said transparent external layer has a thickness less than 1.1 mm.

17. A process according to claim 14, wherein:

said internal layer is opaque.

18. A process according to claim 14, wherein:

said internal layer is clear.

19. A process according to claim 14, further comprising:

decorating an upper portion of a second ski comprising:

transferring a third decoration onto an external surface of a transparent external layer of said second ski, said third decoration being different from said first decoration;

transferring a fourth decoration onto one of (1) an internal surface of said external layer of said second ski and (2) an external surface of an internal layer of said second ski, said fourth decoration being the same as said second decoration; and affixing said transparent external layer of said second ski to said internal layer of said second ski.

* * * * *